United States Patent [19]

Doll et al.

[11] Patent Number: 5,076,868

[45] Date of Patent: Dec. 31, 1991

[54] HIGH PERFORMANCE, LOW COST SOLID PROPELLANT COMPOSITIONS PRODUCING HALOGEN FREE EXHAUST

[75] Inventors: Daniel W. Doll, N. Ogden; Gary K. Lund, Ogden, both of Utah

[73] Assignee: Thiokol Corporation, Ogden, Utah

[21] Appl. No.: 531,728

[22] Filed: Jun. 1, 1990

[51] Int. Cl.[5] ..... C06B 45/10

[52] U.S. Cl. ..... 149/19.4; 149/19.6; 149/20; 149/111

[58] Field of Search ..... 149/19.6, 19.4, 20, 149/111

[56] References Cited

U.S. PATENT DOCUMENTS

| | | | |
|---|---|---|---|
| 2,942,964 | 6/1960 | Burgwald et al. | 149/19.6 |
| 3,004,840 | 10/1961 | Pruitt et al. | 149/19.6 |
| 3,198,677 | 8/1965 | Thomas | 149/19.6 |
| 3,680,483 | 8/1972 | Staudacher et al. | 149/19.6 |
| 3,720,553 | 3/1973 | Henderson | 149/19.6 |
| 3,956,890 | 5/1976 | Davis | 149/19.4 |
| 4,111,728 | 9/1978 | Ramnarace | 149/19.6 |
| 4,165,247 | 8/1979 | Brew et al. | 149/19.6 |
| 4,358,327 | 11/1982 | Reed et al. | 149/19.4 |
| 4,799,980 | 1/1989 | Reed | 149/19.4 |
| 4,925,909 | 5/1990 | Kubota et al. | 149/19.6 |

*Primary Examiner*—Edward A. Miller

*Attorney, Agent, or Firm*—Lawrence I. Field; Ronald L. Lyons

[57] ABSTRACT

High performance solid propellant compositions producing halogen-free exhaust products comprised of Ammonium Nitrate and powdered magnesium and optionally containing polyoxypropylene glycol as a binder.

5 Claims, 2 Drawing Sheets

HIGH PERFORMANCE, LOW COST SOLID PROPELLANT COMPOSITIONS PRODUCING HALOGEN FREE EXHAUST

This invention relates to high performance, low cost solid propellant compositions producing halogen free exhaust. More particularly, it relates to solid propellant compositions which are free of chlorine containing constituents and which therefore produce an exhaust which is free from any chlorine or other halogen either as the element or as a halogen containing compound.

In general, it has been the experience of the propellant industry as a whole, that use of ammonium nitrate as a solid propellant oxidizer in the absence of substantial amounts of ammonium perchlorate (or other similar solid oxidizers) produces unsatisfactory combustion when formulated with aluminum powder. Consequently, propellant performance is poor and addition of combustion improving ingredients such as large amounts of nitrate esters or use of energetic polymers is required to achieve adequate combustion temperatures to ignite the aluminum powder. These additives are expensive and often increase the explosive sensitivity of the composition, greatly increasing propellant costs and complexity.

One object of the invention is to provide a low cost propellant composition in which ammonium nitrate is the sole oxidizer, which burns without leaving any solid or liquid residue and which does not require the presence of energetic polymers or other additives to obtain such complete combustion.

Another object is to provide a propellant composition which does not include any halogen containing constituents.

These and other objects are achieved by a composition in which metallic magnesium is the fuel and ammonium nitrate is the sole oxidizer and which may contain polyoxypropylene glycol as a binder.

Figure 1:
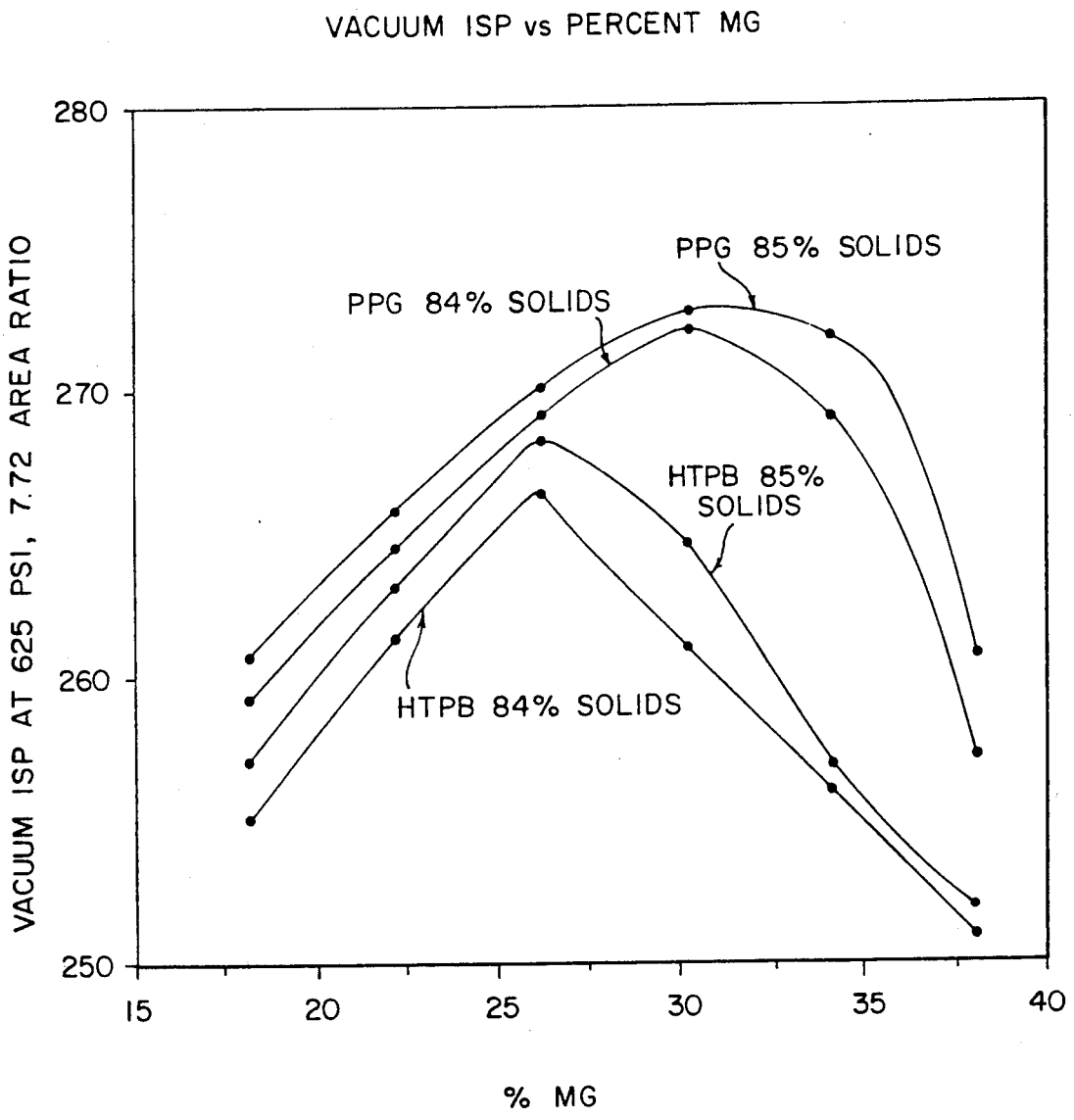
Figure 2:
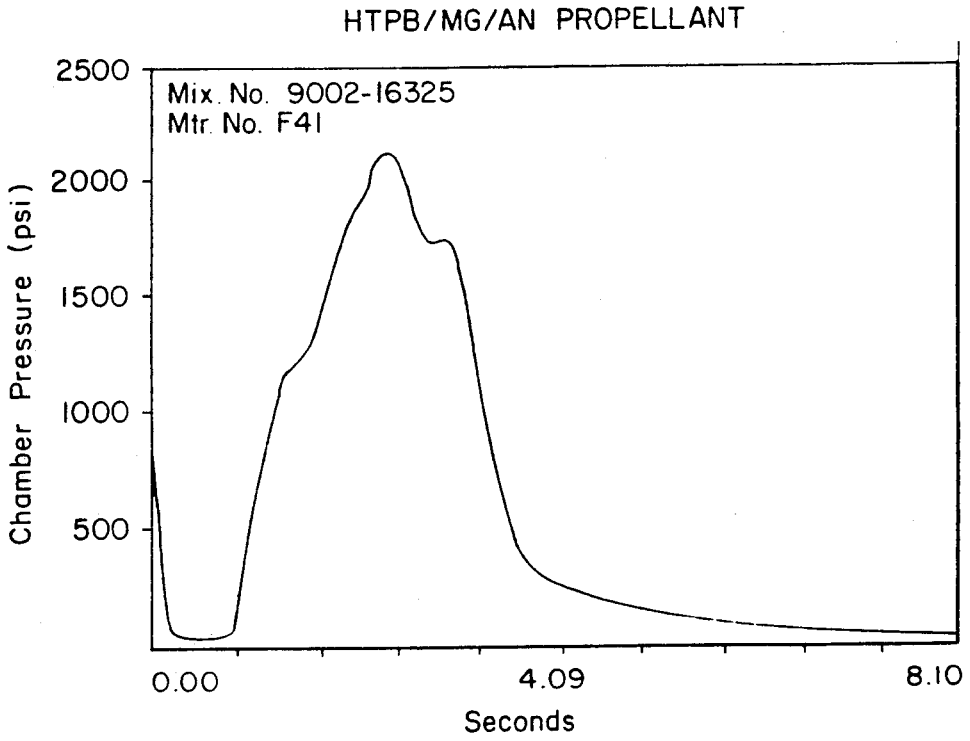
Figure 3:
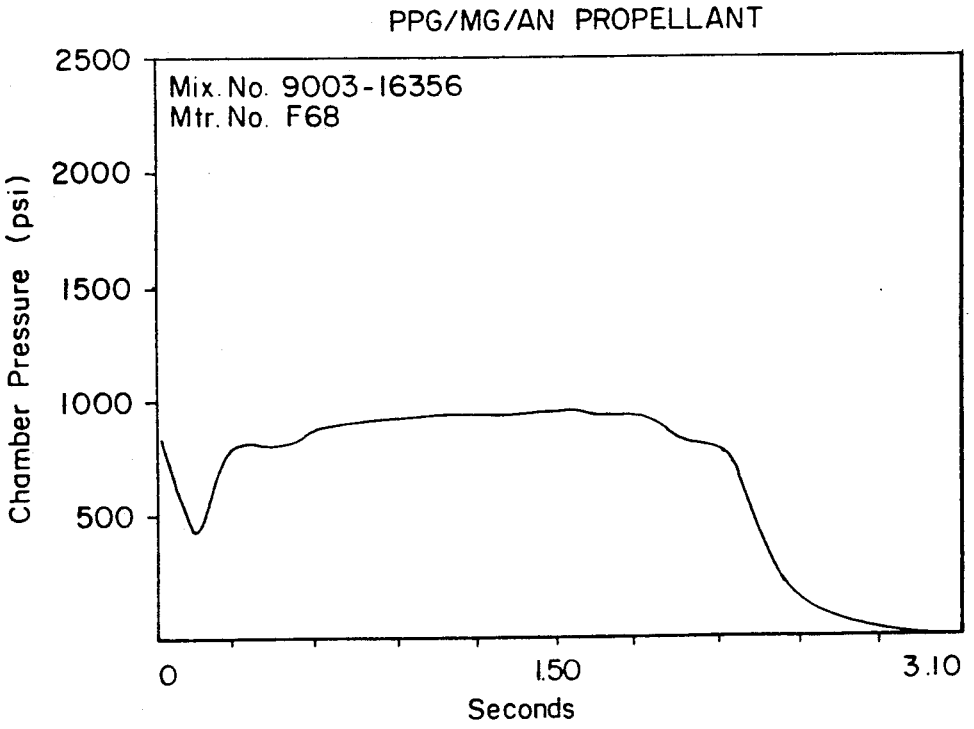

The invention will be more fully understood from the description which follows taken in conjunction with the drawings in which:

FIG. 1 shows graphs depicting theoretical Isp for various percentages of Mg in an Mg/AN propellant for two different binders; and FIGS. 2 and 3 are graphs depicting chamber pressure vs time for two Mg/AN propellants.

AMMONIUM NITRATE

Ordinary fertilizer grade ammonium nitrate is satisfactory in formulating the compositions of this invention, provided it contains less than 0.1% of water, by weight.

For certain applications requiring AN propellants to be exposed to temperatures exceeding 120° F., it is preferred to use AN that contains phase stabilizers (eg. $KNO_3$, ZnO, NiO, MgO, etc.). Usually two particle sizes of AN are used in the propellant compositions of this invention namely: a coarse fraction (200- to 2000-micron) and a fine fraction (20- to 200-micron). The coarse fraction preferably has rounded edges, e.g., a prill. The fine fraction can be ground from the coarse AN. The preferred fine particle size is 40- to 100-micron.

MAGNESIUM

Any Mg powder coarser than 50-micron and finer than 800-micron has been found to be suitable. Smaller sizes (<50-micron) can be used. However, these often present a safety hazard due to ignition sensitivity to electrostatic energy and thus are to be avoided. Spherical or ellipsoidal particles are preferred although not required.

It has been found that formulations utilizing ammonium nitrate as the sole oxidizer ignite and combust completely with little or no slag formation without the addition of high energy ingredients when magnesium powder is employed instead of aluminum powder. Table I compares the ballistic behavior of a series of ammonium nitrate propellants utilizing various binders with combinations of aluminum and magnesium all formulated to equivalent oxidizer to fuel ratios.

BINDER

The AN/Mg propellant compositions may contain a binder. A preferred binder is polyoxypropylene glycol (PPG).

OTHER INGREDIENTS

Other ingredients commonly used in formulating propellant compositions and which may be present in the compositions of this invention include: burn rate catalysts, plasticizers, phase stabilization agents, bonding agents, and the like. Any or all of these may be used, provided they do not contain a halogen such as chlorine.

The propellant ingredients are typically blended in a 1-pint Baker-Perkins vertical mixer. Propellant is vacuum cast into 1.5×2.5 inch center perforated motors for ballistic testing and JANNAF Class C uniaxial tensile specimens for mechanical property testing.

It has been found that formulations utilizing ammonium nitrate as the sole oxidizer ignite and combust completely with little or no slag formation without the addition of high energy ingredients when magnesium powder is employed instead of aluminum powder. Table I compares the ballistic behavior of a series of ammonium nitrate propellants utilizing various binders with combinations of aluminum and magnesium all formulated to equivalent oxidizer to fuel ratios.

TABLE I

| | AN WITH Mg AND Al 85 PERCENT SOLIDS, 15% BINDER | | | | | | | | |
|---|---|---|---|---|---|---|---|---|---|
| | 16372 | 16373 | 16374 | 28883-1 | 28883-2 | 28883-3 | 28886-1 | 28886-2 | 28886-3 |
| Binder | HTPB | HTPB | HTPB | PPG | PPG | PPG | GAP | GAP | GAP |
| Al 20μ | — | 11.40 | 21.0 | — | 13.50 | 25.0 | — | 14.50 | 27.00 |
| Mg Hart 160μ | 25.0 | 11.40 | — | 30.0 | 13.50 | — | 31.50 | 14.50 | |
| AN 600μ | 30.0 | 31.1 | 32.0 | 38.0 | 40.0 | 41.5 | 36.75 | 38.50 | 39.90 |
| AN 35μ | 30.0 | 31.1 | 32.0 | 16.0 | 17.0 | 17.50 | 15.75 | 16.50 | 17.10 |
| Viscosity (kP) | 82 | 37 | 39 | 53 | 19 | 23 | 143 | 112 | >160 |
| Rb (in./sec) | 0.104 | 0.102 | would | 0.140 | would | would | 0.260 | 0.206 | 0.174 |
| Slope | 0.31 | 0.20 | not | 0.26 | not | not | 0.36 | 0.44 | 0.96 |

TABLE I-continued

| AN WITH Mg AND Al 85 PERCENT SOLIDS, 15% BINDER | | | | | | | | |
|---|---|---|---|---|---|---|---|---|
| 16372 | 16373 | 16374 | 28883-1 | 28883-2 | 28883-3 | 28886-1 | 28886-2 | 28886-3 |
| | | ignite | | ignite | ignite | | | |

Rb is propellant burning rate at 1000 psi in inches/second

Use of the energetic binder, GAP(Glycidyl Azide Polymer) resulted in sufficient combustion of either magnesium or aluminum fuel to obtain measurable burning rates, whereas formulations prepared with the non-energetic binders, HTPB(hydroxy terminated polybutadiene) and PPG(polyosypropylene glycol) gave very poor or no combustion in formulations containing aluminum in all cases. In the present invention high cost GAP is not required and lower cost binders may be used.

The use of polyosypropylene glycol offers advantages over the use of hydroxy terminated polybutadiene (HTPB) as it permits substantially higher metal loading than does HTPB, possibly because of the higher oxygen content of PPG. Consequently higher performance (Isp) is achievable with PPG binders than with HTPB binders at the same weight % solids loading.

FIG. 1 compares metal loadings with PPG as the binder vs HTPB as the binder and it will be seen that the former permits higher metal loadings, with consequently higher performance (Isp) than is achieved with HTPB as a binder.

FIGS. 2 and 3 are pressure vs time curves obtained in small motor tests for comparing the combustion behavior of Mg/AN propellants containing PPG and HTPB binders. The pressure versus time trace for Mg/AN propellants, tested in 1.5-×2.5-inch motors, serves to illustrate the improved combustion of PPG binders compared to HTPB binders. Test firings of R-45M (HTPB)/Mg/AN propellants tend to display pressure versus time traces that are indicative of erratic combustion. Test firings of PPG/Mg/AN propellants display pressure versus time traces that are indicative of stable combustion.

Table II is a comparison of the ballistic and mechanical properties of both PPG and HTPB based Mg/AN propellants.

TABLE II

| Mg/AN Propellant Comparison | | | | | | |
|---|---|---|---|---|---|---|
| Binder | % Solids | % Ground AN | % Mg (160μ) | Rb | n | |
| HTPB | 85 | 18 | 25 | 0.102 | 0.11 | Kp = 50-100 |
| | | 21 | | 0.121 | 0.59 | Kp = >100 |
| | | 24 | | 0.114 | 0.42 | |
| | | 27 | | 0.118 | 0.33 | |
| | | 30 | | 0.115 | 0.42 | |
| | | 30 (1% $Al_2O_3$) | | 0.085 | 0.23 | |
| | | 30 (1% Pyrocat) | | 0.103 | 0.69 | |
| PPG/DOA | 85 | 15 | 25 | 0.134 | 0.134 | Kp = 50-100 |
| | | 18 | | 0.127 | 0.120 | |
| | | 21 | | 0.127 | 0.092 | |
| | | 24 | | 0.133 | 0.120 | |
| PPG/DOA | 84 | 16 | 30 | 0.134 | 0.169 | Kp = 50-100 |
| | | 19 | | 0.138 | 0.098 | Kp = >100 |
| | | 22 | | 0.135 | 0.232 | |
| | | 25 | | 0.146 | 0.244 | |
| | | 28 | | 0.130 | 0.350 | |
| | | 34 | | 0.148 | 0.253 | |
| | | 37 | | 0.145 | 0.33 | |

| MECHANICAL PROPERTIES FOR Mg/AN PROPELLANTS | | |
|---|---|---|
| | PPG Binder 85 Solids, 25 Mg, 18% Ground | HTPB Binder 85 Solids, 25 Mg, 30% Ground |
| $E^{2.6}$ (psi) | 348 | 480-1780 |
| $\epsilon_m^c$ (%) | 15 | 9-12 |
| $\epsilon_f$ (%) | 19 | 12-22 |
| $\sigma_m^c$ (psi) | 49 | 40-127 |
| Shore A | 50 | 48-73 |

Rb is propellant burning rate at 1000 psi
n is ballistic pressure exponent
$E^{2.6}$ is propellant modulus (psi)
$\epsilon_m^c$ is propellant strain corrected maximum stress (%)
$\epsilon_f$ is propellant strain at failure (%)
$\sigma_m^c$ is corrected maximum propellant stress (psi)

The overall costs of the propellants is lowest with PPG binder formulations. The low viscosity and low hydroxyl reactivity of PPG combine to allow room temperature processing and cure of the formulations using highly reactive cure catalysts such as dibutyltindilaurate. PPG/Mg/AN propellant formulations have been found to achieve a full state of cure at ambient temperature in a similar time as required for conventional propellants which are cured at elevated (120°-135° F.) temperatures.

The ability to process and cure at room temperature is particularly important for ammonium nitrate propellants since ammonium nitrate undergoes volume expansion due to crystalline phase changes above about 100° F. Thus, very inexpensive, non-phase stabilized grades of ammonium nitrate may be employed in these formulations without peril provided use temperature requirements do not exceed the phase transition temperatures.

In summary the compositions of this invention comprise the following in percent by weight:

| | |
|---|---|
| AN (oxidizer) | 40–70 |
| Mg (fuel) | 16–36 |
| Binder (PPG) | 10–25 (12–18 preferred) |

As indicated above , other additives commonly used in propellant compositions may be included in the compositions provided they do not include any halogen or halogen containing compounds.

One specific example of a preferred propellant formulation shown below, contains a binder (which is also a fuel) that is typically composed of a PPG polymer, curative, plasticizer, and a cure catalyst. The main fuel is Mg metal (160-micron) and the non-chlorine oxidizer is solely comprised of AN (600-micron and 35-micron).

Typical properties of the sample composition are: burn rate (ips) at 1000 psi=0.14, burn rate pressure exponent=0.26, strain (%)=15, and stress=50 psi.

| Ingredient | % by weight |
|---|---|
| Binder | |
| PPG Polymer | 11.89 |
| Isophorone Diisocyanate (Curative) | 1.10 |
| Dioctyl Adipate (Plasticizer) | 2.00 |
| Dibutyltin Diacetate (Catalyst) | 0.01 |
| Fuel | 30.00 |
| Mg Metal | |
| Oxidizer | 55.00 |

-continued

| Ingredient | % by weight |
|---|---|
| $NH_4NO_3$(Coarse & fine) | . |

Having now described a preferred embodiment of the invention it is not intended that it be limited except as may be required by the appended claims, we claim:

1. A high-performance, low-cost, solid propellant composition in which ammonium nitrate is the sole oxidizer and which consists essentially of the following in weight percent:

| | |
|---|---|
| Ammonium Nitrate (coarse and fine particles) | 40–70 |
| Magnesium Particles (coarser than 50 microns and finer than 800 microns) | 16–36 |
| Combustible Binder | 10–25 |

and wherein the combustible binder is a polyoxypropylene glycol cured with an aliphatic diisocyanate.

2. The composition of claim 1 wherein teh coarse particles are 200–2000 microns and the fine particles are 20–200 microns.

3. The composition of claim 2 wherein the fine particles are 40–100 microns.

4. The composition of claim 1 including a phase stabilizer for the ammonium nitrate.

5. The composition of claim 1 in which the proportions are approximately 55% $NH_4NO_3$, 30% Mg powder and 15% binder.

* * * * *